US010495305B2

(12) United States Patent
Lambkin et al.

(10) Patent No.: US 10,495,305 B2
(45) Date of Patent: Dec. 3, 2019

(54) OVEN DOOR ASSEMBLY

(71) Applicant: Whirlpool Corporation, Benton Harbor, MI (US)

(72) Inventors: Todd William Lambkin, Stevensville, MI (US); Joel Matthew Sells, Watervliet, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 834 days.

(21) Appl. No.: 13/680,439

(22) Filed: Nov. 19, 2012

(65) Prior Publication Data

US 2014/0139095 A1 May 22, 2014

(51) Int. Cl.
*F23M 11/04* (2006.01)
*F24C 15/02* (2006.01)
*F24C 15/04* (2006.01)

(52) U.S. Cl.
CPC ..... *F23M 11/04* (2013.01); *F24C 15/024* (2013.01); *F24C 15/04* (2013.01)

(58) Field of Classification Search
CPC ..... F23M 11/04; F23M 11/042
USPC ..... 126/190, 200; 49/391
See application file for complete search history.

(56) References Cited

U.S. PATENT DOCUMENTS 2,877,761 A 3/1959 Schibley
3,577,973 A * 5/1971 Katona ..... 126/200
3,656,471 A * 4/1972 Olson ..... 126/200
4,041,930 A * 8/1977 Katona ..... 126/198
4,048,978 A * 9/1977 Plumat et al. ..... 126/200
4,060,069 A * 11/1977 Drouin ..... 126/200
4,206,338 A * 6/1980 Katona ..... 219/740
4,253,286 A * 3/1981 Katona ..... 52/171.1
4,384,567 A * 5/1983 Katona ..... F23M 11/042 126/200
4,390,767 A * 6/1983 Bucksbaum et al. ..... 219/740
4,606,324 A * 8/1986 Katona ..... F24C 15/04 126/198
4,716,884 A * 1/1988 Bonaccorsi et al. ..... 126/198
4,817,585 A * 4/1989 Craver ..... 126/200
5,387,258 A * 2/1995 Puricelli ..... F24C 15/2007 126/198
5,735,261 A * 4/1998 Kieslinger ..... F24C 15/04 126/190
5,819,722 A 10/1998 Katz
6,135,130 A * 10/2000 Martineau ..... 134/113
7,655,885 B2 * 2/2010 Kim et al. ..... 219/391
7,703,451 B2 4/2010 Bang
7,708,007 B2 * 5/2010 Kim et al. ..... 126/198
7,819,113 B2 * 10/2010 Chin ..... 126/200
8,857,422 B2 * 10/2014 Elkasevic ..... 126/200
2006/0027230 A1 * 2/2006 Jung ..... 126/200
2007/0251520 A1 * 11/2007 Bang ..... 126/200
2009/0255524 A1 * 10/2009 Venezia et al. ..... 126/198
2012/0216789 A1 * 8/2012 Vazquez Garcia et al. ..... 126/200

(Continued)

FOREIGN PATENT DOCUMENTS

WO 2010132057 A1 11/2010

*Primary Examiner* — Gregory L Huson
*Assistant Examiner* — Aaron H Heyamoto
(74) *Attorney, Agent, or Firm* — McGarry Bair PC

(57) ABSTRACT

A door assembly for an oven comprises an inner frame, a first glass panel and a first pair of brackets coupled with the inner frame and compressively retaining the first glass panel against the inner frame.

19 Claims, 9 Drawing Sheets

(56) References Cited

U.S. PATENT DOCUMENTS

| | | | | |
|---|---|---|---|---|
| 2012/0261371 | A1* | 10/2012 | Baines | 211/123 |
| 2013/0019854 | A1* | 1/2013 | Lim et al. | 126/198 |
| 2015/0020792 | A1* | 1/2015 | Raggi et al. | 126/198 |

* cited by examiner

OVEN DOOR ASSEMBLY

BACKGROUND

Conventional domestic cooking ovens include a door assembly which provides selective access to a cooking cavity where food items can be placed to cook. The door assembly typically includes one or more glass panels to provide a viewing window for a user to view the food items within the cooking chamber without opening the door. The size of the viewing window is often limited by the dimensions of the various components of the door assembly. The door assembly can also be provided with insulation to minimize the amount of heat transferred from the cooking cavity to outside surfaces of the door assembly during a cooking cycle to minimize the chance of injury during contact between a user and the outside surfaces of the door. The insulation and framing used to hold the insulation in place can increase the cost of manufacturing the door assembly and also restrict the size of the viewing window.

BRIEF SUMMARY

A door assembly for an oven comprises an inner frame having a flange defining an opening, a first glass panel having a first pair of opposing sides and a second pair of opposing sides and a first pair of brackets coupled with the inner frame and compressively retaining the first pair of opposing sides of the first glass panel against the flange while the second pair of opposing sides is not compressively retained by the first pair of brackets.

DETAILED DESCRIPTION

Figure 1:
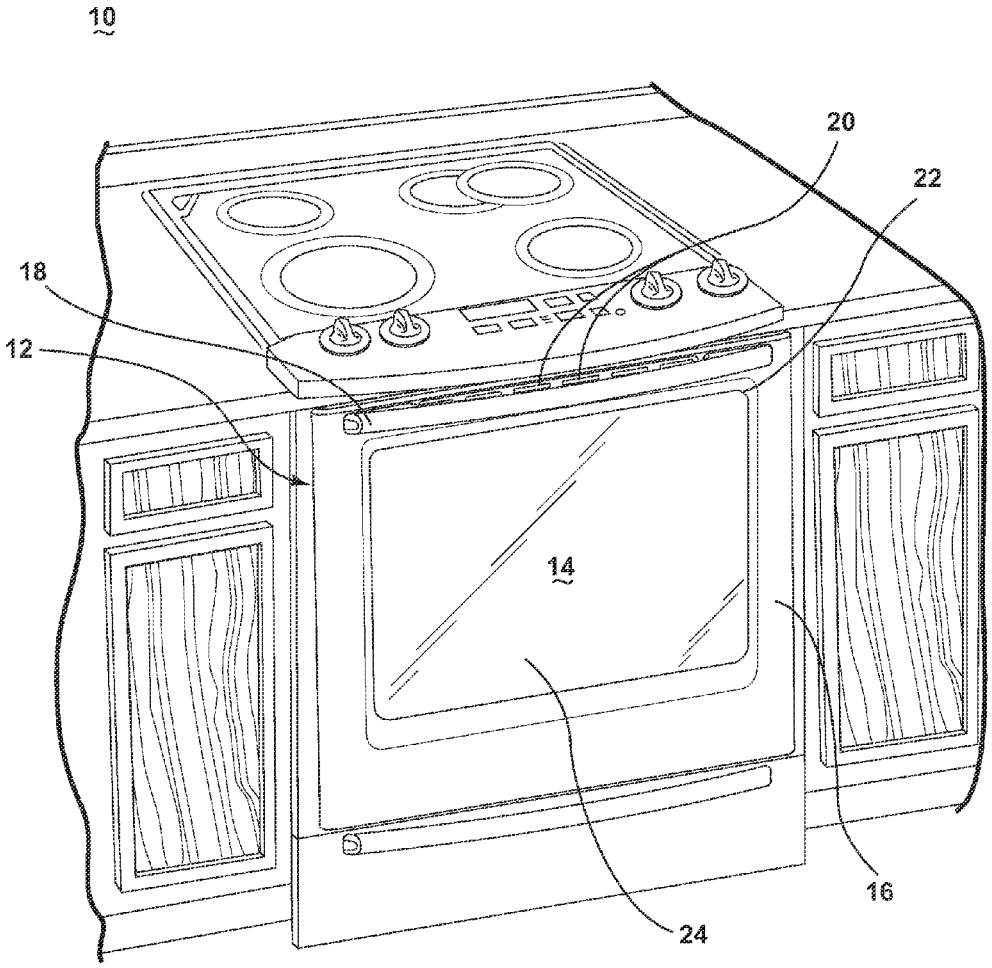
FIG. 1 is a perspective view of an oven having a door assembly in a closed condition according to an embodiment of the invention.
Figure 2:
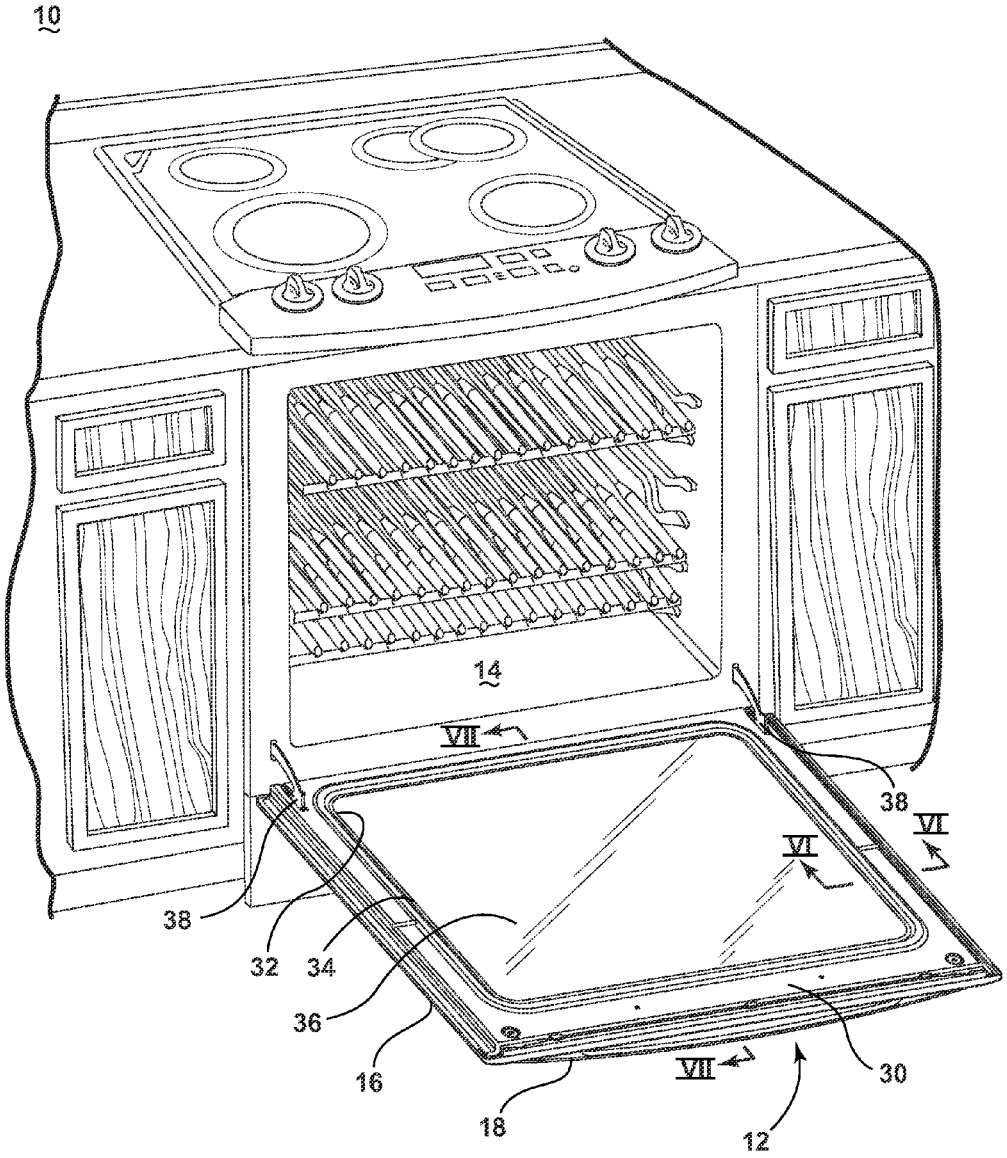
FIG. 2 is a perspective view of the oven of FIG. 1 with the door assembly in an open condition according to an embodiment of the invention.

FIGS. 1 and 2 illustrate an oven 10 having a door assembly 12. The details of the oven 10 are not germane to the embodiments of the invention and will only be described to the extent it is necessary to understand the embodiments of the invention. The door assembly 12 may be used with any type of oven 10, such as a gas or electric oven, to selectively provide access to a cooking chamber 14.

The door assembly 12 can include an outer frame 16 and a handle 18. The outer frame 12 can include a plurality of vents 20 and an opening 22 through which an outer glass panel 24 is visible. Referring now to FIG. 2, the door assembly 12 further includes an inner frame 30 having an opening 32 defined by an inner frame flange 34 through which an inner glass panel 36 is visible. The door assembly 12 can further include a pair of mounting hinges 38 for attaching the door assembly 12 to the oven 10. While the outer panel 24 and inner panel 36 are described in the context of being made from glass, it will be understood that the outer and inner panels 24, 36 may be made from any suitable transparent or partially transparent material.

Figure 3:
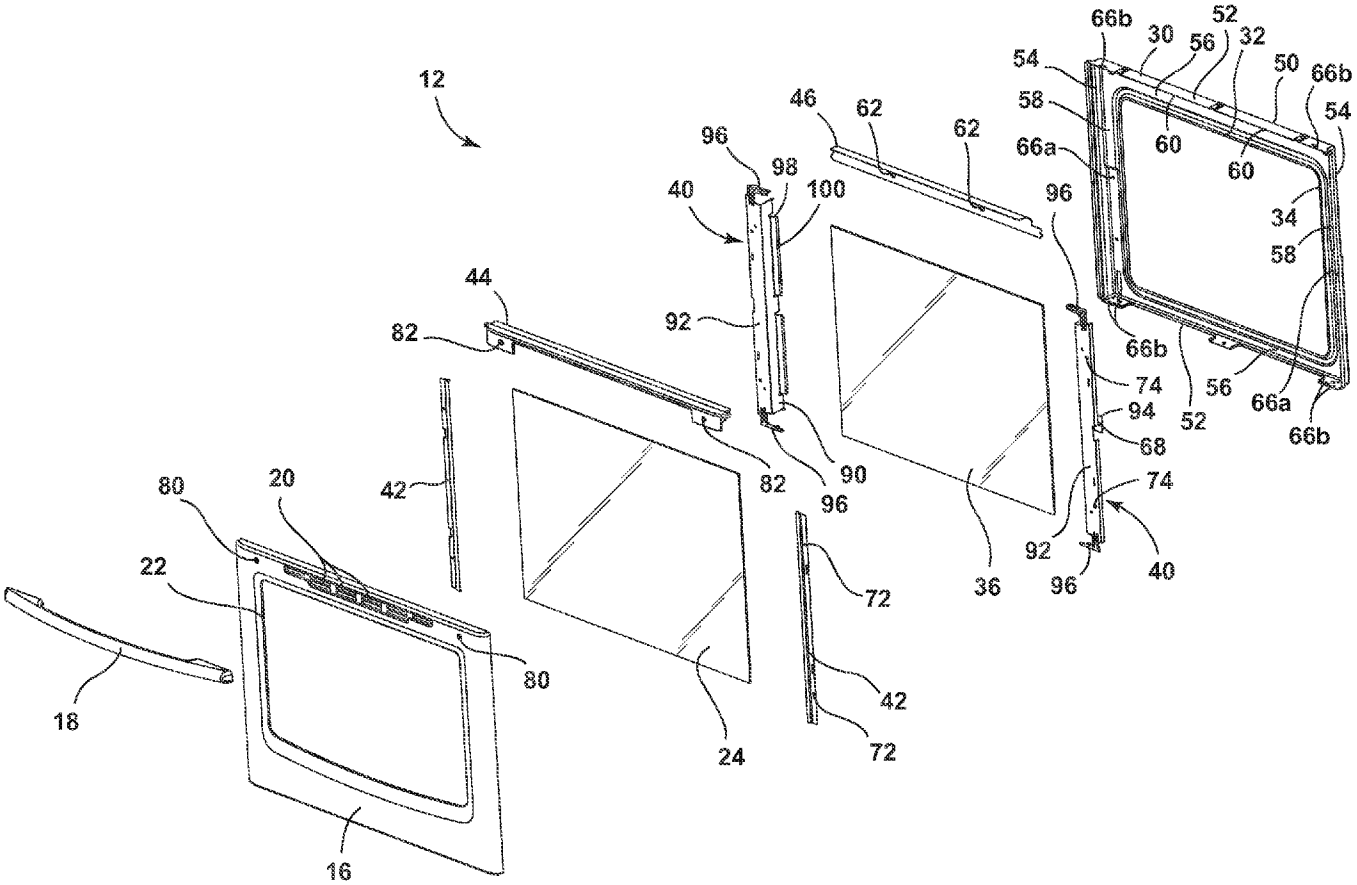
FIG. 3 is an exploded view of a door assembly according to another embodiment of the invention.

Referring now to FIG. 3, the door assembly 12 includes a pair of first, inner brackets 40 for mounting the inner glass panel 36 to the inner frame 30, a pair of second, outer brackets 42 for mounting the outer glass panel 24 to the inner brackets 40 and a handle mounting bracket 44 for mounting the handle 18 to the outer frame 16. The door assembly 12 may also include an upper bracket 46 for mounting the inner glass panel 36 to the inner frame 30. The inner frame 30 may include a rear face 50, opposing upper and lower horizontal flanges 52 and opposing vertical flanges 54. The rear face 50 may include upper and lower portions 56 extending between the inner frame opening 32 and the upper and lower horizontal flanges 52 and lateral portions 58 extending between the inner frame opening 32 and the vertical flanges 54.

Still referring to FIG. 3, the inner frame 30 may include a plurality of apertures that align with the inner brackets 40 and upper bracket 46 for coupling the inner brackets 40 and the upper bracket 46 with the inner frame 30. For example, the inner frame 30 may include a first set of inner frame apertures 60 on the upper portion 56 of the rear face 50 that align with apertures 62 in the upper bracket 46 for coupling the inner frame 30 with the upper bracket 46 through a mechanical fastener, such as a screw or set pin. The inner frame 30 may also include a second set of inner frame apertures 66*a* in the lateral portions 58 of the rear face 50 that align with a first inner bracket aperture 68 on each inner bracket 40 (see FIGS. 4A and 4B) and a third set of inner frame apertures 66*b* on upper and lower horizontal flanges 52 of the inner frame 30 that align with a second set of inner bracket apertures 70 (see FIGS. 4A and 4B) on the inner bracket 40 for coupling the inner frame 30 with the inner bracket 40.

Each of the outer brackets 42 may also include a pair of apertures 72 that align with a third set of inner bracket apertures 74 for coupling the outer bracket 42 and the inner bracket 40 with mechanical fasteners. The outer frame 16 may include a set of apertures 80 that align with a set of apertures 82 in the handle mounting bracket 44 for coupling the handle 18 with the with the outer frame 16.

It will be understood that the embodiments of the invention are not limited to the position and number of coupling apertures and mechanical fasteners illustrated in FIG. 3, but that additional or fewer coupling apertures and mechanical fasteners may also be used.

Figure 4B:
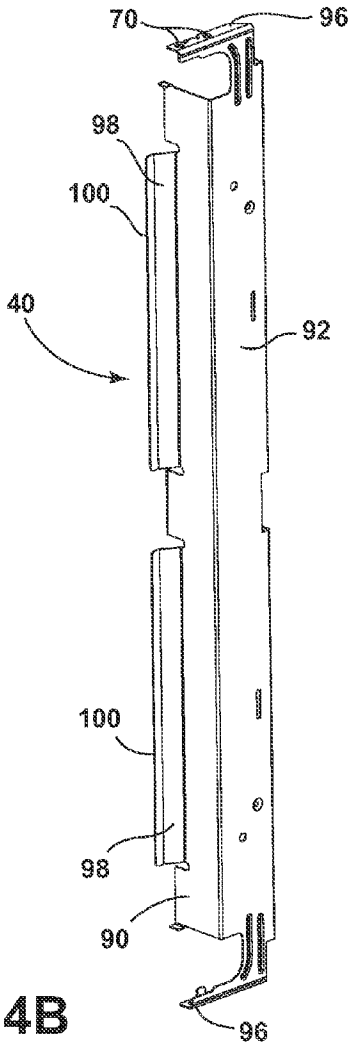
FIGS. 4A and 4B are first and second side perspective views of a bracket of the door assembly of FIG. 3 according to an embodiment of the invention.
Figure 4A:
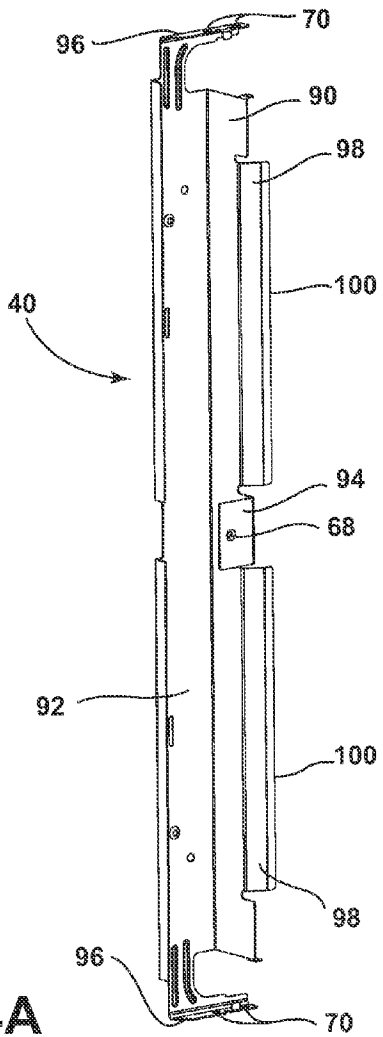

Referring to FIGS. 4A and 4B, the inner bracket 40 is configured such that the same inner bracket 40 can be used on both lateral sides of the inner frame 30, negating the need for a unique bracket for each side. Each inner bracket 40 includes a first leg 90 and a second leg 92 extending orthogonally from a first distal end of the first leg 90. A first mounting flange 94 extends orthogonally from a second distal end of the first leg 90 opposite the first distal end. The first mounting flange 94 includes the first inner bracket aperture 68 for mounting the inner bracket 40 to the inner frame 30. A pair of second mounting flanges 96 extends from opposite ends of the second leg 92. The second mounting flanges 96 include the second set of inner bracket apertures 70 for mounting the inner bracket 40 to the inner frame 30. Each inner bracket 40 further includes a pair of compression flanges 98 extending from the first leg 90 on either side of the first mounting flange 94 and extending in a direction opposite the first mounting flange 94.

Figure 5:
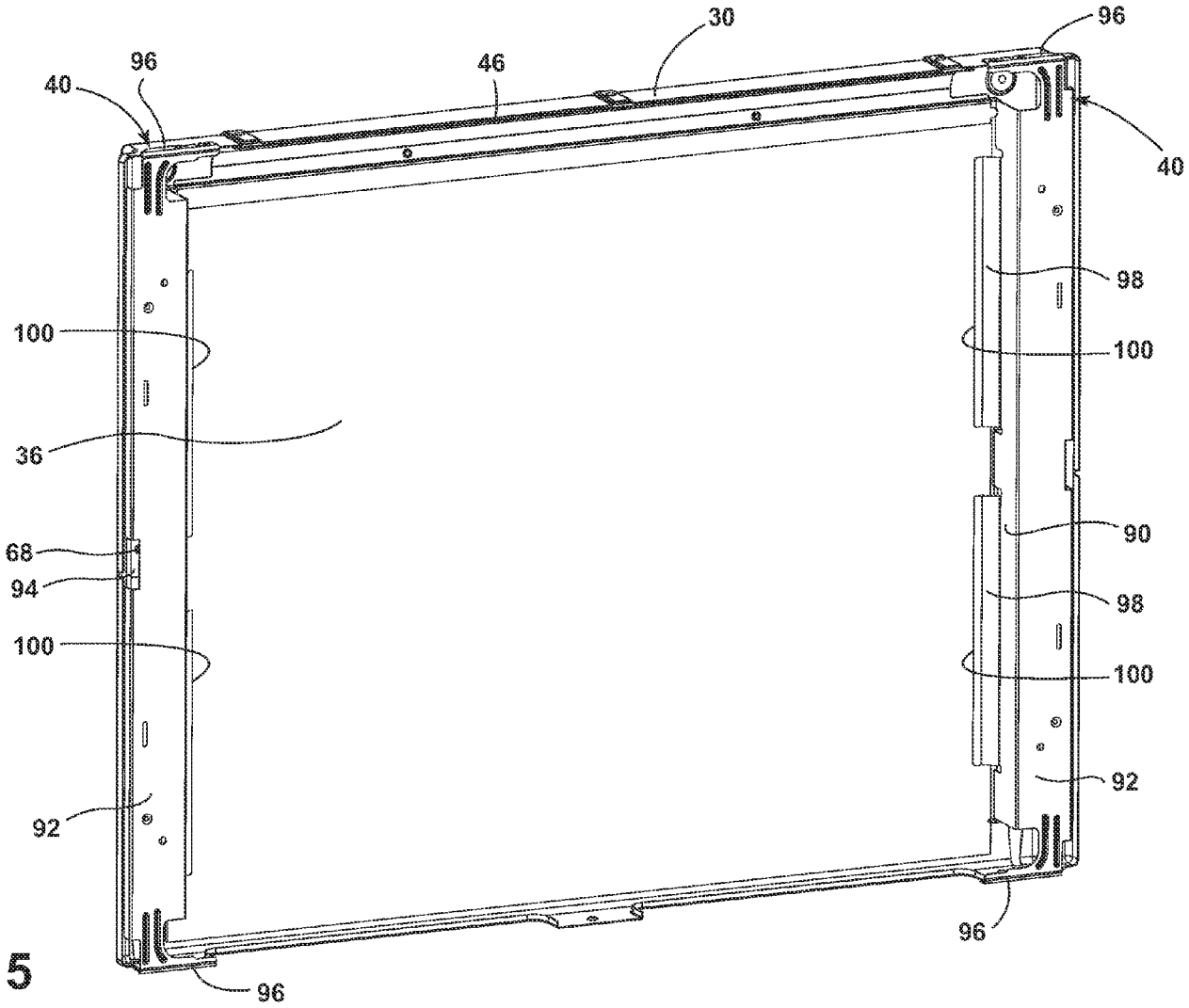
FIG. 5 is a perspective view of a partially assembled door assembly according to an embodiment of the invention.
Figure 6:
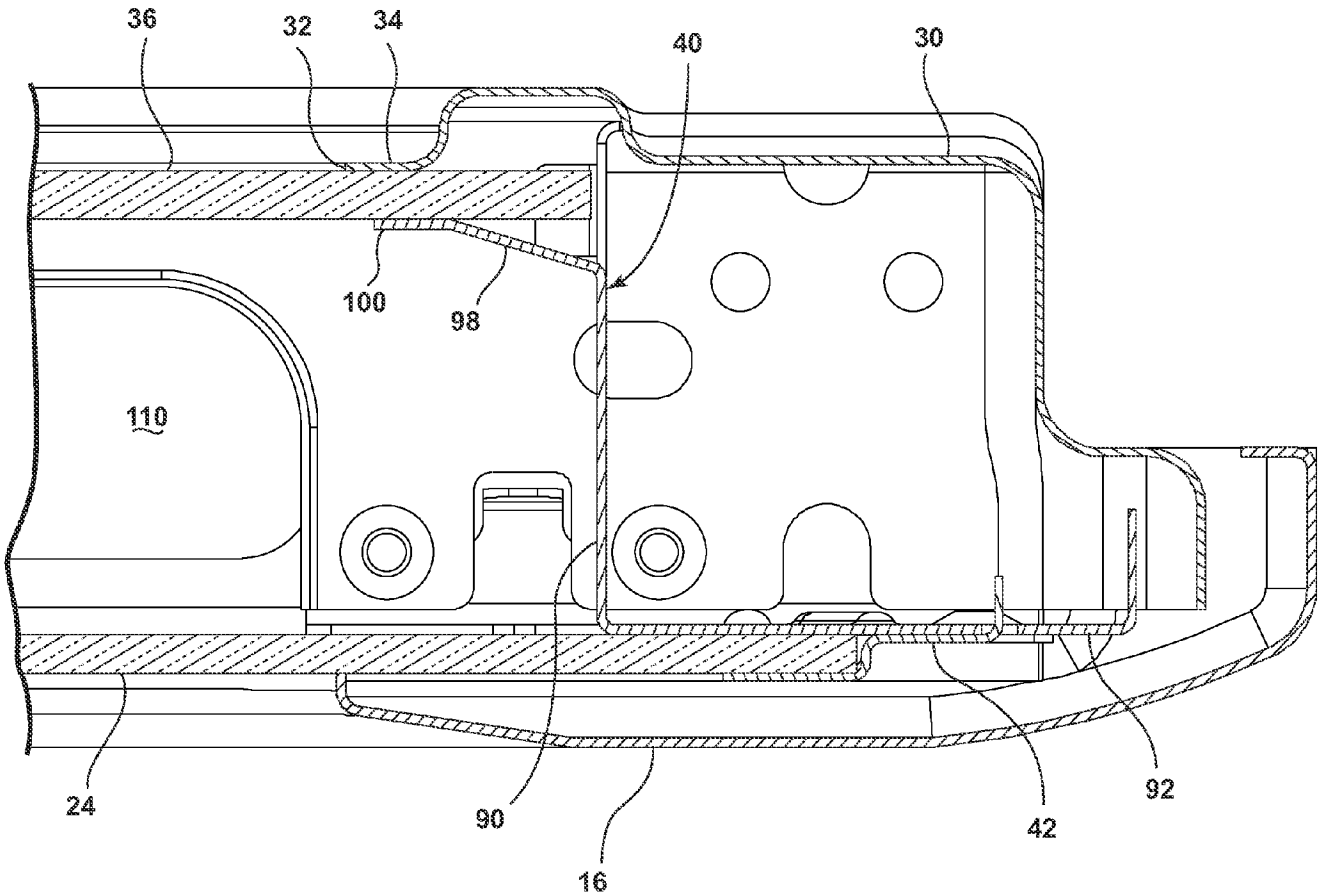
FIG. 6 is a cross-sectional view of the door assembly of FIG. 2 along the lines 6-6 according to an embodiment of the invention.

As can be seen in FIGS. 5 and 6, when the inner bracket 40 and inner glass panel 36 are assembled with the inner frame 30, a distal portion 100 of the compression flanges 98 press the inner glass panel 36 against the inner frame flange 34, sealing the inner glass panel 36 against the inner frame 30 without the use of a seal or gasket. The inner bracket 40 can be mounted to the inner frame 30 using an appropriate fastener through the first inner bracket aperture 68 on the first mounting flange 94. As the inner bracket 40 and inner frame 30 are drawn together, the inner glass panel 36 is compressed between the compression flanges 98 of the inner bracket 40 and the inner frame flange 34 of the inner frame 30.

Still referring to FIG. 6, when the outer and inner frames 16 and 30 and the outer and inner glass panels 24 and 36 are assembled, an air gap 110 is formed between the outer glass panel 24 and the inner glass panel 36. The width of the air gap 110 is defined by the length of the first leg 90 of the inner bracket 40, which is used to mount both the outer glass panel 24 and the inner glass panel 36 within the door assembly 12. The air gap 110 provides a space for air to flow between the outer glass panel 24 and the inner glass panel 36, insulating the outer glass panel 24 from the inner glass panel 36 and also providing cooling to the outer glass panel 24.

Figure 7:
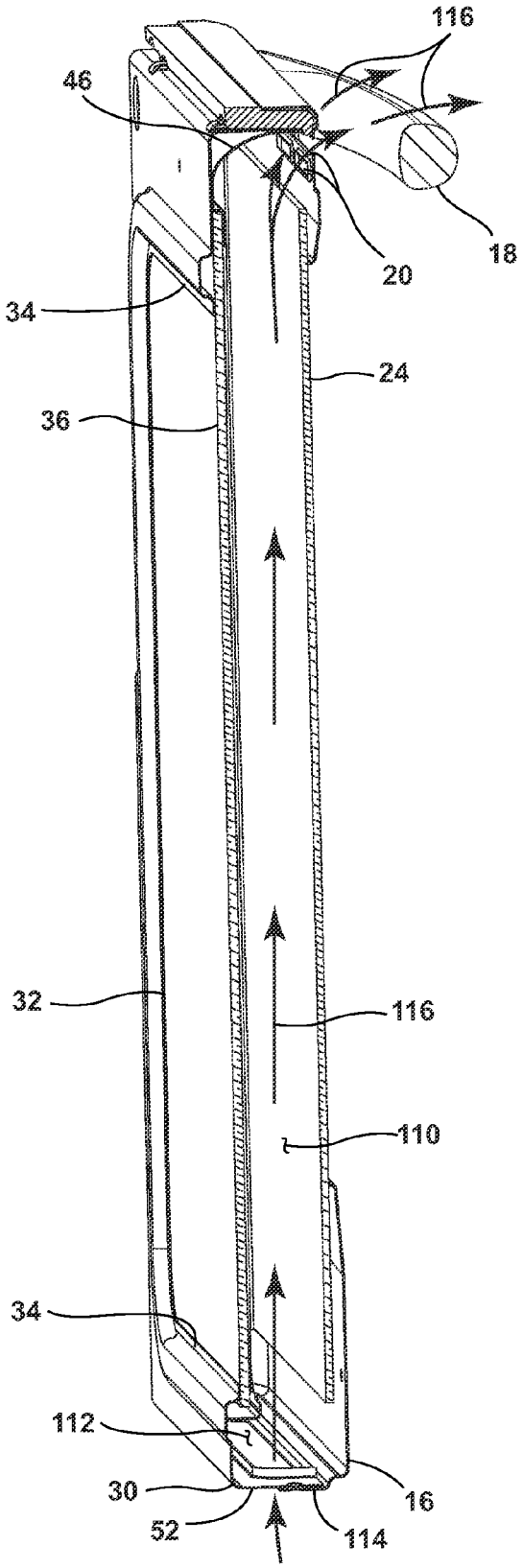
FIG. 7 is a cross-sectional view of the door assembly of FIG. 2 along the lines 7-7 according to an embodiment of the invention.

As illustrated in FIG. 7, air can enter the air gap 110 between the outer glass panel 24 and the inner glass panel 36 at a bottom of the door assembly 12 through an opening 112 formed by the lower horizontal flange 52 of the inner frame 32 and a lower horizontal flange 114 of the outer frame 16. As illustrated by the arrows 116, air can enter the air gap 110 through the opening 112, flow between the outer glass panel 24 and the inner glass panel 36 and be exhausted through the vents 20 in the outer frame 16.

When the oven 10 is in use, the heated cooking cavity 14 heats the adjacent components of the door assembly 12, particularly the inner frame 30 and the inner glass panel 36, which are in direct communication with the cooking cavity 14. Air in the air gap 110 can insulate the outer glass panel 24 from heat emanating from the inner glass panel 36 and also provide a cooling effect as air external to the cooking cavity 14 is drawn through the air gap 110 and exhausted through the vents 20. As the inner glass panel 36 is heated, air may be drawn into the air gap 110 via a chimney effect. The oven 10 may also be provided with a fan to force air through the air gap 110. In this manner, the outer frame 16 and outer glass panel 24 can be kept relatively cool even when the cooking cavity 14 is being heated during a cooking cycle, thus decreasing the risk of a burn injury as a result of contact with the outer frame 16 or the outer glass panel 24.

Typically, ovens include insulation packed between the outer frame and the inner frame of the door assembly to keep the outside of the door assembly relatively cool during use of the oven. The insulation can take up a lot of valuable space in the door assembly and also require structural components to mount and maintain the insulation within the door assembly. Because the oven 10 described herein utilizes air flow to cool the outer components of the door assembly 12, the door assembly 12 does not include any additional insulation and thus does not require an insulation mounting frame, which can decrease the cost of the door assembly 12 in terms of labor and materials.

In addition, the use of a pair of inner brackets 40 for mounting the outer and inner glass panels 24 and 36 rather than a frame that encompasses the entire glass panel utilizes less space within the door assembly 12 and can also provide cost savings in terms of installation time and materials compared to a full size frame. The compression of the inner glass panel 36 against the inner frame flange 34 of the inner frame 30 by the compression flanges 98 of the inner bracket 40 without the use of additional gaskets or seals can provide additional cost savings.

Figure 8:
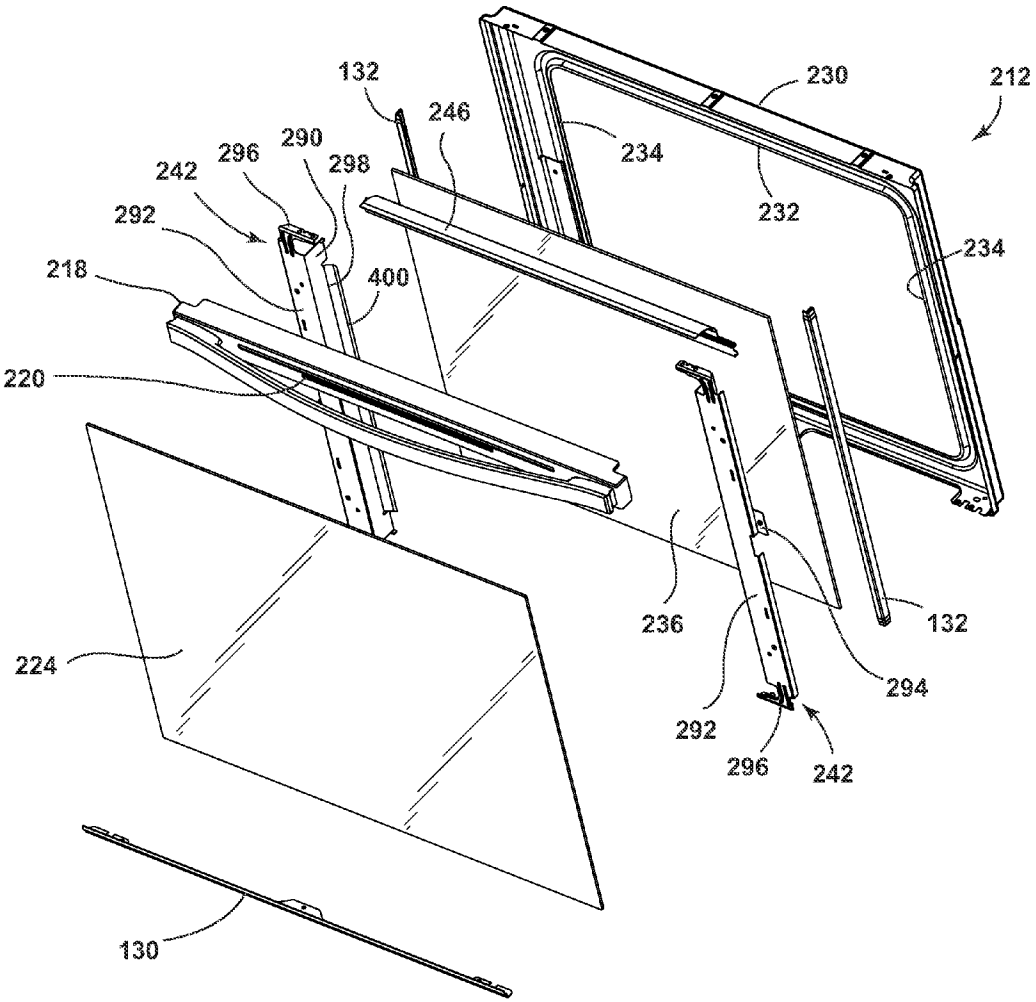
FIG. 8 is an exploded view of a door assembly according to another embodiment of the invention.

Furthermore, because the inner brackets 40 do not take up a lot of space within the door assembly 12, the inner brackets 40 can be used with door assemblies which maximize the size of the viewing window for providing a user with a view of the contents of the cooking chamber 14. For example, FIG. 8 illustrates a door assembly 212, which is similar to the door assembly 12, except for the door assembly 212 does not include the outer frame 16. Therefore, elements of the door assembly 212 similar to those of the door assembly 12 will be labeled with the prefix 200.

Still referring to FIG. 8, the inner glass panel 236 can be mounted to the inner frame 230 in the same manner as described above with respect to the door assembly 12, with the compression flanges 298 pressing the inner glass panel 236 against the inner frame flange 234 of the inner frame 230. The outer glass panel 224 can be inserted into a channel (not shown) in the handle assembly 318, which is then mounted to the inner frame 230. The door assembly 212 can further be provided with a bottom trim piece 130 for supporting and covering a bottom edge of the outer glass panel 224 and a pair or side trim pieces 132.

The handle assembly 218 is used to mount the outer glass panel 224 adjacent the second leg 292 of the inner bracket 240 without the use of the outer brackets 42 of the door assembly 12. In this manner, when the door assembly 212 is assembled, the air gap between the outer glass panel 224 and inner glass panel 236 and partially defined by the first leg 290 of the inner bracket 240 is still present. Air can flow between the outer glass panel 224 and the inner glass panel 236 and exhaust through the vents 220 in the handle assembly 218.

Figure 9:
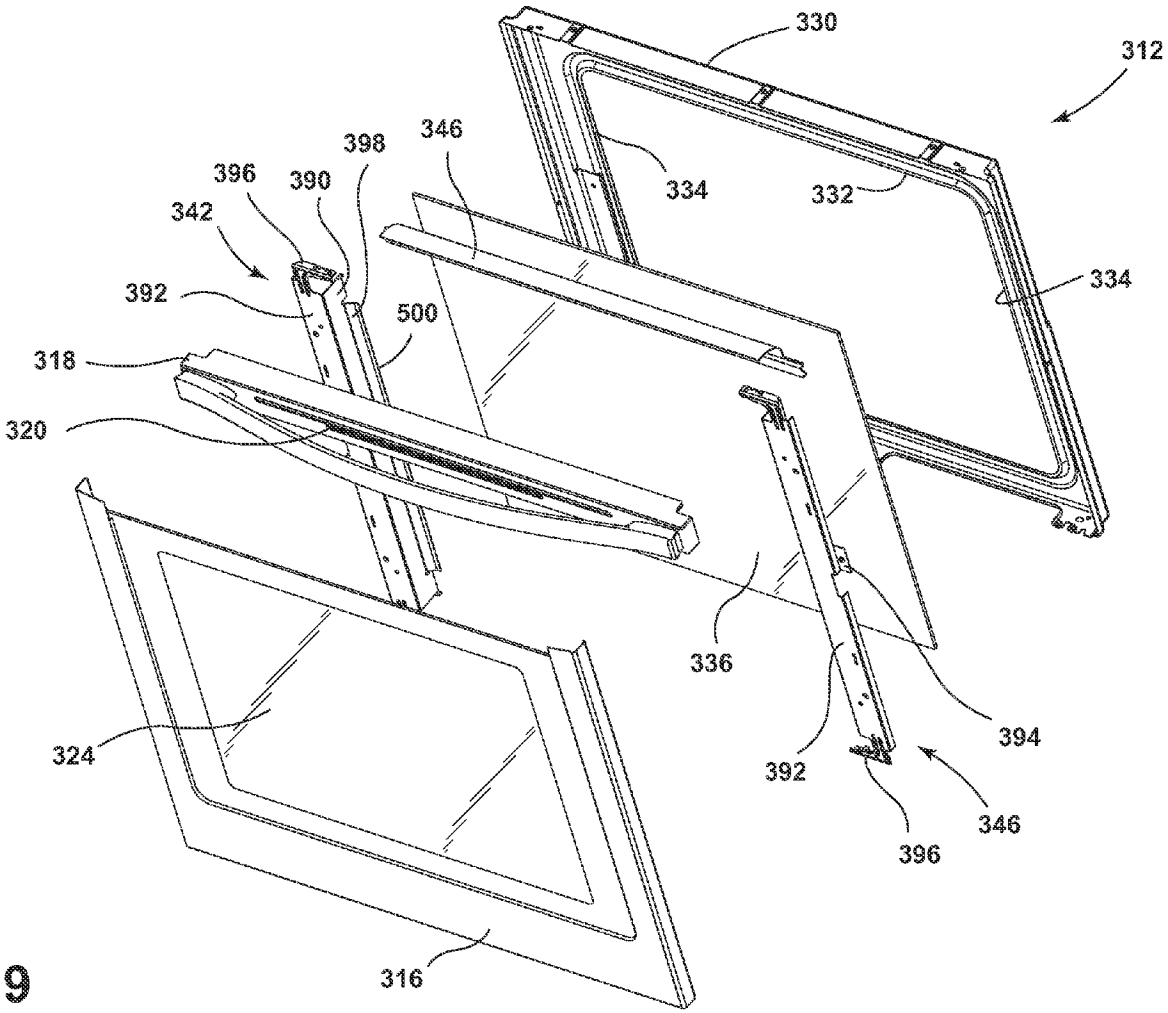
FIG. 9 is an exploded view of a door assembly according to another embodiment of the invention.

FIG. 9 illustrates an additional exemplary door assembly 312 which is similar to the door assembly 12 except for the manner in which the outer glass panel 324 is mounted to the inner frame 330. Therefore, elements of the door assembly 312 similar to those of the door assembly 12 will be labeled with the prefix 300.

Still referring to FIG. 9, the outer glass panel 324 is secured to an outer skin 316 using an adhesive. The handle assembly 318 can include a channel (not shown) for receipt of an upper edge of the outer glass panel 324 and outer skin 316. The handle assembly 318 can then be fastened to the inner frame 330 to secure the outer glass panel 324 adjacent to the second leg 392 of the inner brackets 340. The inner glass panel 336 is compressively retained against the inner frame flange 334 by the compression flanges 398 of the inner brackets 340 in a manner similar to that described above for the door assembly 12. In this manner, when the door assembly 312 is assembled, the air gap between the outer glass panel 324 and the inner glass panel 336 and partially defined by the first leg 390 of the inner bracket 340 is still present. Air can flow between the outer glass panel 324 and the inner glass panel 336 and exhaust through the vents 320 in the handle assembly 318.

The embodiments described herein provide for an oven door assembly having inner and outer glass panels separated by an air gap through which air can flow to insulate and cool the outer glass panel. The door assembly includes a pair of inner brackets that compressively retain the inner glass panel against the inner frame of the door assembly without the use of additional seals or gaskets. In addition, the use of a pair of inner brackets rather than a traditional frame which is used to mount the inner glass panel or to secure insulation within the door assembly provides cost savings in terms of installation labor and materials costs. The inner brackets partially define the air gap between the inner and outer glass panels and provide a mounting system which can be used with a variety of outer frame components. The minimal space utilized by the pair of inner brackets compared with a traditional mounting frame also allows for door assemblies having larger viewing windows.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A door assembly for an oven comprising:

a rear frame having a flange defining an opening;

an innermost glass panel having a first pair of opposing sides and a second pair of opposing sides; and a first pair of brackets coupled with the rear frame and compressively retaining the first pair of opposing sides of the innermost glass panel directly against the flange while the second pair of opposing sides is not compressively retained by the first pair of brackets.

2. The door assembly of claim 1 wherein each of the first pair of brackets comprises a bracket flange that compressively contacts the innermost glass panel.

3. The door assembly of claim 2, further comprising a second glass panel coupled with the first pair of brackets.

4. The door assembly of claim 3 wherein each of the first pair of brackets comprises a bracket arm, substantially orthogonal to the bracket flange, and wherein the innermost glass panel, second glass panel and bracket arm at least partially define a vented air gap.

5. The door assembly of claim 1, further comprising a second glass panel coupled with the first pair of brackets.

6. The door assembly of claim 5, further comprising a second pair of brackets coupled with the first pair of brackets and wherein the second glass panel is retained between the first pair of brackets and the second pair of brackets.

7. The door assembly of claim 5 wherein a vented air gap is formed between the innermost glass panel and the second glass panel.

8. The door assembly of claim 5, further comprising an outer frame adjacent the second glass panel.

9. The door assembly of claim 5, further comprising a handle assembly coupled with the pair of brackets, wherein the handle assembly comprises a channel for receiving the second glass panel and retaining the second glass panel against the first pair of brackets.

10. A door assembly for an oven comprising:

a rear frame having a flange defining an opening;

an innermost glass panel having a first pair of opposing sides and a second pair of opposing sides;

a first pair of brackets coupled with the rear frame and compressively retaining the first pair of opposing sides of the innermost glass panel directly against the flange while the second pair of opposing sides is not compressively retained by the first pair of brackets; and a second glass panel coupled with the first pair of brackets;

wherein the innermost glass panel is spaced from the second glass panel to form a vented air gap between the innermost glass panel and the second glass panel.

11. The door assembly of claim 10 wherein each of the pair of brackets comprises a bracket flange that compressively contacts the innermost glass panel.

12. The door assembly of claim 11 wherein each of the pair of brackets comprises a bracket arm, substantially orthogonal to the bracket flange, and wherein the vented air gap is at least partially defined by the bracket arm, the innermost glass panel and the second glass panel.

13. The door assembly of claim 10, further comprising a second pair of brackets coupled with the first pair of brackets and wherein the second glass panel is retained between the first pair of brackets and the second pair of brackets.

14. The door assembly of claim 10, further comprising an outer frame adjacent the second glass panel.

15. The door assembly of claim 10, further comprising a handle assembly coupled with the pair of brackets, wherein the handle assembly comprises a channel for receiving the second glass panel and retaining the second glass panel against the pair of brackets.

16. A household oven comprising:

a housing at least partially defining a cooking chamber for receiving items for cooking; and a door assembly moveably mounted to the housing to selectively close the cooking chamber and having an rear frame with a flange, a innermost glass panel having a first pair of opposing sides and a second pair of opposing sides, and a first pair of brackets coupled with the rear frame and compressively retaining the first pair of opposing sides of the innermost glass panel directly against the flange while the second pair of opposing sides is not compressively retained by the first pair of brackets.

17. The household oven of claim 16, further comprising a second glass panel coupled with the first pair of brackets.

18. The household oven of claim 17, further comprising a second pair of brackets coupled with the first pair of brackets and wherein the second glass panel is retained between the first pair of brackets and the second pair of brackets.

19. The household oven of claim 18 wherein a vented air gap is formed between the innermost glass panel and the second glass panel.

* * * * *